United States Patent [19]

Willems et al.

[11] 4,346,262

[45] Aug. 24, 1982

[54] SPEECH ANALYSIS SYSTEM

[75] Inventors: Leonardus F. Willems; Leonardus L. M. Vogten, both of Eindhoven, Netherlands

[73] Assignees: N.V. Philips' Gloeilampenfabrieken; Technische Hogeschool Eindhoven, both of Eindhoven, Netherlands

[21] Appl. No.: 135,963

[22] Filed: Mar. 31, 1980

[30] Foreign Application Priority Data

Apr. 4, 1979 [NL] Netherlands ..... 7902631

[51] Int. Cl.[3] ..... G10L 1/00

[52] U.S. Cl. ..... 179/1 SA

[58] Field of Search ..... 179/1 SA, 1 SB, 1 SC, 179/1 SD, 1 SE; 364/513, 514, 724, 725; 333/166; 324/77

[56] References Cited

U.S. PATENT DOCUMENTS 4,220,819 9/1980 Atal ..... 179/1 SA

OTHER PUBLICATIONS

J. Flanagan, "Speech Analysis, Synthesis and Perception", Second Ed., Springer-Verlag, 1972, (In Particular pp. 224, 225, and 364).

B. Gold et al., "Analysis of Digital and Analog Formant Synth.", IEEE Trans. Audio and El., Mar. 1968, pp. 81-94.

*Primary Examiner*—Mark E. Nusbaum

*Assistant Examiner*—E. S. Kemeny

*Attorney, Agent, or Firm*—Thomas A. Briody; William J. Streeter; Edward W. Goodman

[57] ABSTRACT

In a formant speech analysis synthesis system, formant extraction to control a recursive digital all-pole filter encounters the problem that pole-pairs are not orderly arranged and that real poles may occur which are not representative of formants. The problem is solved by transforming the coefficients of the second-order sections of the filter to coefficients which can be easily ordered and by means of which it is simple to assign formants to the real poles.

1 Claim, 4 Drawing Figures

SPEECH ANALYSIS SYSTEM

BACKGROUND OF THE INVENTION (1) Field of the Invention

The invention relates to a speech analysis system wherein a recursive digital all-pole filter is determined such that a function derived from the filter approaches a function derived from the speech as closely as possible.

The invention relates in particular to the determination of the formants from the filter coefficients for later use in a speech synthesizing arrangement comprising a cascade of second-order all-pole filters which are controlled by the formant data.

(2) Description of the Prior Art

In an article in the IEEE Transactions on Acoustics, Speech and Signal Processing, Vol. ASSP-22, No. 2, April 1974, pages 135–141 it is pointed out that an obvious method for extracting the formants would be to solve for the poles by setting the denominator of the transfer function of the filter to zero.

An article in the Journal of the Acoustic Society of America, Vol. 63, No. 5, May 1978, pages 1638–1640 states that an all-pole filter can be considered as a cascade of several first-order and second-order all-pole filters. FIG. 1 shows a known speech synthesizing arrangement based thereon for an even number of poles. This arrangement consists of a pulse generator 1, a noise generator 2, a voiced-unvoiced switch 3, an amplifier 4 and a cascade of second-order all-pole filters 5, 6, 7 and 8.

The pulse generator 1 is controlled by the pitch parameter Fo. The switch 3 is controlled by the voiced-/unvoiced information V/U. The amplitude parameter A controls the amplifier 4. The filters 5, 6, 7 and 8 are controlled by the formant parameters $F_1$, $B_1$; $F_2$, $B_2$; $F_3$, $B_3$ and $F_4$, $B_4$, which specify the formant frequency (F) and the bandwidth (B).

A method of computing the filter coefficients of the higher order digital filter is known from Proceedings of the International Congress on Acoustics, C-5-5, Tokyo, Japan, August 1968 (see reference in the book Speech Analysis Synthesis and Perception, second edition, by J. L. Flanagan, pages 364–367, Springer-Verlag, 1972). This method uses the short-time auto-correlation function of the speech.

For the determination of the pole-pairs of the all-pole filter, use can be made of the Bairstow method for solving for the complex roots of an algebraic equation with real coefficients. This method is described in the book Introduction to Numerical Analysis by C. E. Fröberg, Addison, Wesley, 1965.

A problem in Formant extraction is, that the pole-pairs do not always occur in such an order that they can be simply assigned to certain formant areas and that real poles may occur which may not be interpreted as formants.

The formants, i.e. the central formant frequency and the bandwidth, can be computed from the pole-pairs and these data can be arranged in the order of increasing frequency. However, this offers no solution for the real poles with which no central frequency is associated.

SUMMARY OF THE INVENTION

It is an object of the invention to provide in a simple manner in a speech analysis system of the present type an ordering of the pole-pairs.

In the present speech analysis system this object is accomplished by means of the method comprising the steps:

transforming the coefficients $p_i$ and $q_i$ of the n second order sections of the filter, having the transfer functions $$H_i = \frac{1}{1 + p_i z^{-1} + q_i z^{-2}} \quad i = 1, \ldots, n$$

wherein $z^{-1} = \exp(-sT)$ and s represents the complex frequency $s = \alpha + jw$ and T the sampling period, into the coefficients $c_i$ and $r_i$ in accordance with the equations $$c_i = p_i / \sqrt{|q_i|}$$

$$r_i = \text{sign}\,(q_i)^* \sqrt{|q_i|}$$

limiting the values of the coefficients $c_i$ and $r_i$ to values located in a range limited by the values $c = -2$, $c = +2$, $r = 1$ and $r = 0$.

arranging the combinations of coefficients ($c_i$, $r_i$) in order of increasing values of $c_i$.

The real poles are made complex by limiting the coefficients $c_i$ and $r_i$ in the manner as mentioned above so that formants can be determined in a simple manner. It appears that this limitation of the coefficients has no audible effect on the ultimate, synthesized speech.

The central formant frequencies $F_i$ and the bandwidths $B_i$ can be computed from the coefficients $c_i$ and $r_i$, which are located in the above-mentioned range, in accordance with the equations:

$$r_i = e^{-\pi B_i T}$$

$$C_i = 2 \cos (2\pi F_i T)$$

This results in an ordered sequence of formant data (F, B) wherein no empty spaces occur as a result of the occurrence of real poles in the filter transfer functions. In other words, control information is always available for the speech synthesizing arrangement according to FIG. 1 without interruption and in the proper sequence and for the proper filter.

SHORT DESCRIPTION OF THE FIGURES

DESCRIPTION OF THE PREFERRED EMBODIMENT

Figure 1:
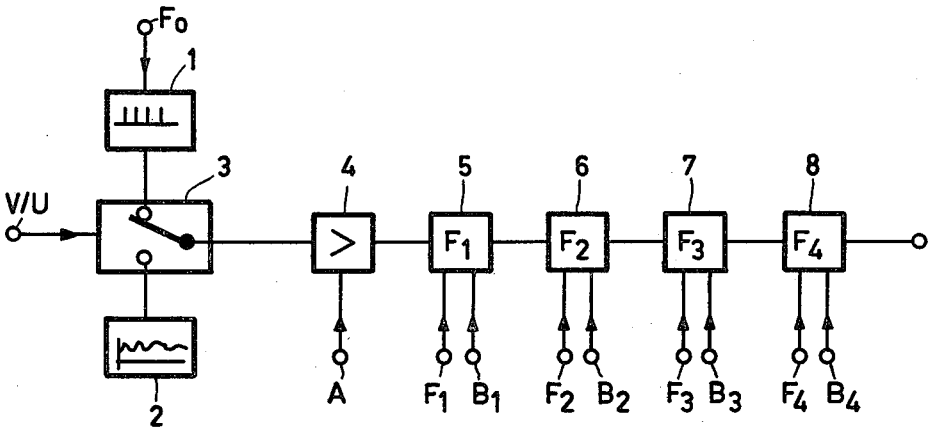
FIG. 1 is the circuit diagram of a known speech synthesizing arrangement.

In the speech analysis system to be described with reference to FIG. 2, segments having a duration of 25 ms are separated from a speech signal. This function is represented by block 9 bearing the inscription 25 ms. The next operation is multiplication of the speech signal segment by a "Hamming window", this function being represented by block 10 bearing the inscription WNDW.

The sampling frequency is, for example, 8000 Hz, so that a 25 ms segment comprises 200 samples. The multiplication by the "window" results in the signal samples $s_j$, $j=1, \ldots 200$. Thereafter, the auto-correlation coefficients $r_k$, $k=1, \ldots, 8$ are computed from these signal samples, as shown by block 11. The filter coefficients $a_j$, $j=1, \ldots 8$ are computed from these coefficients $r_k$ by means of a group of 8 linear equations, as represented by block 12.

The filter coefficients $a_j$ are the coefficients of the all-pole filter having the transfer function:

$$H = \frac{1}{1 + \sum_{j=1}^{8} a_j z^{-j}} \tag{1}$$

The transfer function H is split by means of the Bairstow algorithm, into four second order transfer functions $H_i$.

$$H = \frac{1}{\prod_{i=1}^{4} (1 + p_i z^{-1} + q_i z^{-2})} = \prod_{i=1}^{4} H_i \tag{2}$$

This last-mentioned operation is represented by block 13. This operation results in the four coefficients combination $(p_i, q_i)$, $i=1, \ldots 4$.

Figure 3:
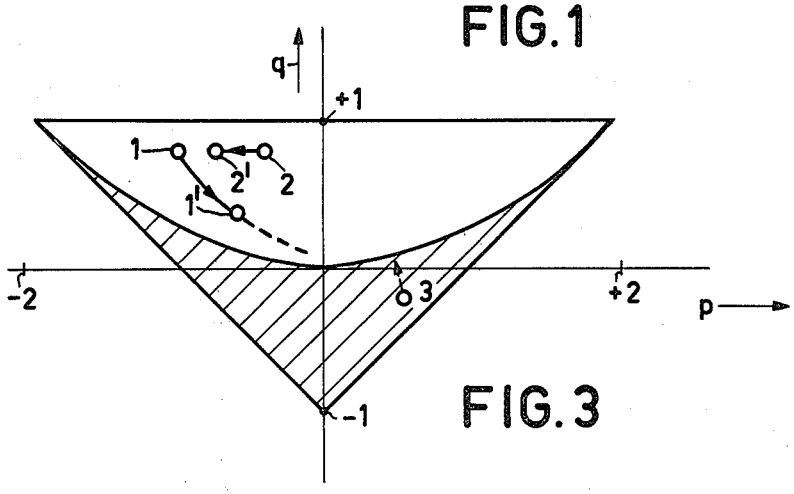
FIG. 3 is a diagram for showing the positions of the poles of a second order digital filter.

The possible combinations $(p_i, q_i)$ are located within the triangle, shown in FIG. 3, in the p, q-plane. The combinations corresponding with complex poles are located above the parabola $p^2-4\,q=0$; the combinations corresponding with the real poles are located below the parabola in the hatched portion of the triangle.

A combinations $(p_i, q_i)$ is associated with the formant frequency $F_i$ and the bandwidth $B_i$ in accordance with the equations $$p_i = -2w^{-\pi B_i T} \cdot \cos 2\,\pi F_i T \tag{3}$$

$$q_i = e^{-2\pi B_i T}$$

wherein T represents the sampling period.

In FIG. 3 a (p, q) combination is shown at point 1 and at point 2 a (p, q) combination is shown which corresponds with a formant having a higher frequency and the same bandwidth as the formant associated with point 1. When the bandwidth of the formant associated with point 1 increases with no change in the formant frequency, the corresponding point moves from 1 to 1' along a parabola. A movement from point 2 to point 2' corresponds with a decreasing formant frequency with no change in the formant bandwidth.

A well-ordered arrangement of the (p, q) combination in accordance with ascending formant frequencies is not simple as it is not possible to indicate clearly defined areas which are associated with the formants in the p, q-plane. This is illustrated by the displacements of the formant from point 1 to point 1' and from point 2 to point 2' in certain circumstances. In practice it is difficult to allow for the real poles (point 3) from the hatched area in this ordered arrangement.

The speech analysis system described so far is of a conventional construction and belongs to the prior art. The new features according to the present invention will now be described.

In the speech analysis system arranged in accordance with the invention, coordinate transformation of the coordinates p, q to the coordinates c, r is performed in accordance with the equation:

$$c = p / \sqrt{|q|} \tag{4}$$

$$r = \text{sign}\,(q) * \sqrt{|q|}$$

This operation is represented by block 14. In response to this transformation, the triangle of FIG. 3 is transformed to the figure in the c, r-plane shown in FIG. 4. The points 1 and 1' and 2 and 2' of FIG. 3 are again shown in FIG. 4. The parabola 1 - 1' of FIG. 3 is a straight line in FIG. 4.

The coordinate transformation results in the coefficients combinations $(c_i, r_i)$, which subsequently are arranged in accordance to ascending values of the coefficients $c_i$. This elementary operation of the ordering of the pole-pairs is represented by block 15, bearing the inscription RDR.

Figure 4:
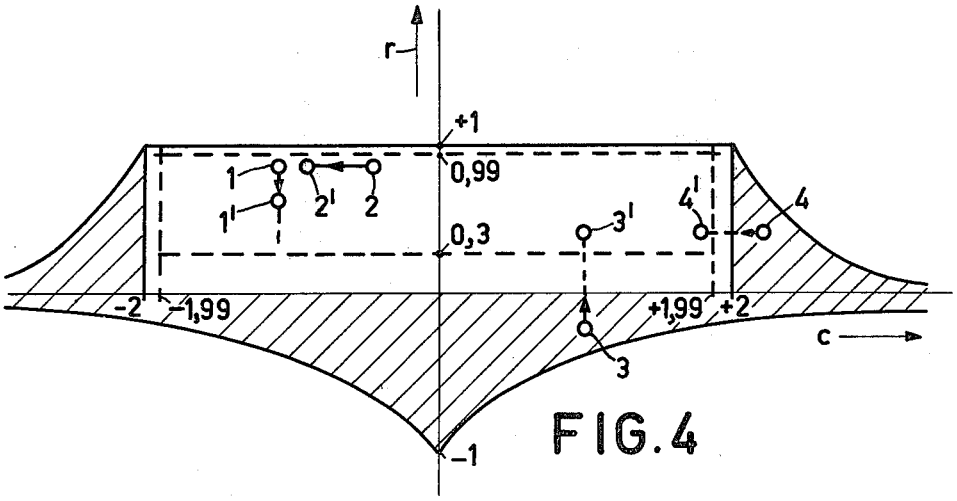
FIG. 4 is a second diagram with transformed coordinates for showing the poles of second order filter section.

The combinations $(c_i, r_i)$ located in the hatched area of FIG. 4 and corresponding with real poles are shifted to the rectangular area which is limited by the values $c=-2$, $c=+2$, $r=1$ and $r=0$, within which the complex poles are located. This is effected by limiting the values of the coefficients $c_i$ and $r_i$. This function is represented by block 16. The limit values for $c_i$ are, for example, $-1.99$ and $+1.99$ and for $r_i$, for example, 0.3 and 0.99.

The last-mentioned operation may be denoted the complexing of the real poles of the transfer function of the all-pole filter. As a result of this operation a real pole which is represented by point 3 is shifted to point 3' and a real pole represented by point 4 is shifted to point 4'. The coordinate transformation thus renders it possible to assign formants to real poles in a simple manner. In other words: the operation of block 16 always produces combinations $(c_i, r_i)$, $i=1, \ldots, 4$, with which formants correspond. The real pole of point 3 is also shown in FIG. 3, from which it is less clear how a formant can be assigned to this pole.

The coefficient combination $(c_i, r_i)$ which is derived from block 16 is associated with the formant frequency $F_i$ and the bandwidth $B_i$ in accordance with the equations:

$$c_i = -2 \cos (2\pi F_i T) \tag{5}$$

$$r_i = e^{-\pi B_i T}$$

The combinations $(F_i, B_i)$, $i=1, \ldots, 4$ can be computed by means of the equations (5). This function is represented by block 17.

The speech analysis system results in a group of four ordered $(F_i, B_i)$ combinations, with which the four filters 5 to 8 of the speech synthesizing arrangement shown in FIG. 1 can be controlled for reproducing the speech. The present speech analysis system always produces four $(F_i, B_i)$ combinations in the proper sequence, so that none of the filters 5 to 8 does not receive control information, or receives the information of an adjacent filter.

Figure 2:
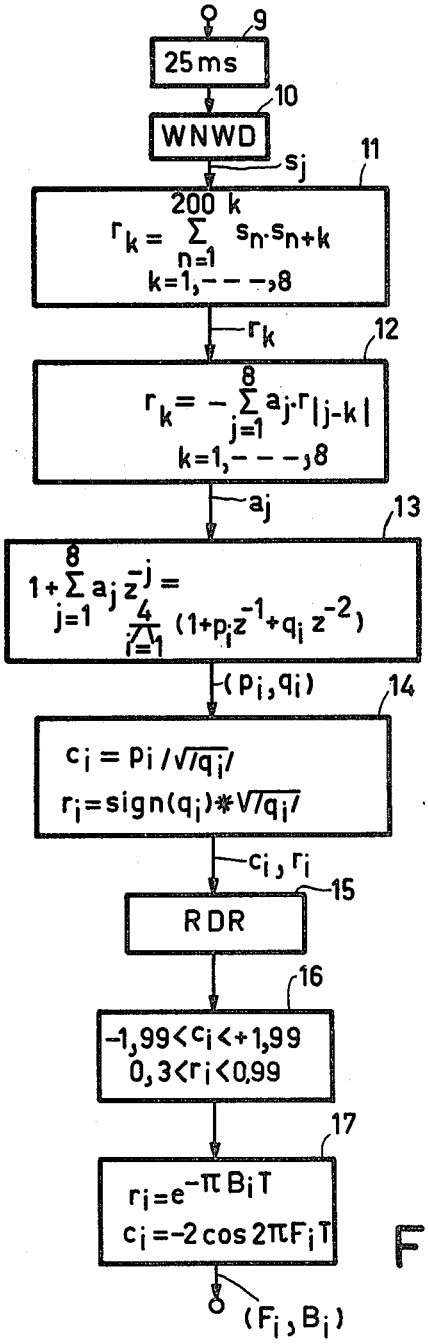
FIG. 2 is a flow chart which illustrates the sequence of operations for an embodiment of the speech analysis system in accordance with the invention.

The flow chart of FIG. 2 may be implemented by standard microprocessor hardware in combination with standard memories for data and program storage. The programming of such a micro-computer according to the flow chart of FIG. 2 is within the realm of the non skilled in the art.

What is claimed is:

1. In a speech analysis system, the method of determining the formant parameters for a recursive digital all-pole filter whereby a function derived from the filter approaches, as closely as possible, a function derived from the speech, the method comprising the steps:

sampling, at a predetermined rate, segments, of a specified duration,, of the speech signal;

determining the auto-correlation coefficients $r_k$ from the signal samples $s_j$, wherein:

$$r_k = \sum_{n=1}^{j} s_n \cdot s_{n+k}$$

determining the filter coefficients $a_j$ from the autocorrelation coefficients $r_k$, wherein:

$$r_k = -\sum_{j=1} a_j \cdot r_{|j-k|}$$

determining the coefficient combinations $p_i$ and $q_i$ of the n second-order sections of the digital all-pole filter, wherein the transfer function thereof is split into n second-order transfer functions:

$$\frac{1}{1 + \sum_{j=1} a_j \cdot z^{-j}} = \frac{1}{\prod_{i=1}^{n} (1 + p_i \cdot z^{-1} + q_i \cdot z^{-2})}$$

where $z^{-1} = \exp(-sT)$, s being the complex frequency $s = +jw$ and T the sampling period;

transforming the coefficient combinations $p_i$ and $q_i$ into the coefficients $c_i$ and $r_i$ in accordance with the equations:

$$c_i = \frac{p_i}{\sqrt{|q_i|}}, \; r_i = \text{sign}(q_i) * \sqrt{|q_i|}$$

limiting the values of the coefficients $c_i$ and $r_i$ to values located in an area limited by the values $c = -2$, $c = 2$, $r = 1$ and $r = 0$;

arranging the coefficient combinations $c_i$ and $r_i$ in order of increasing values of $c_i$; and determining the formant parameters $F_i$ and $B_i$ using the equations:

$$r_i = e^{-\pi B_i T},$$

$$C_i = -2 \cos 2\pi F_i T$$

controlling said fiter utilizing said formant parameters to generate said filter-derived speech function.

* * * * *

UNITED STATES PATENT AND TRADEMARK OFFICE

CERTIFICATE OF CORRECTION

PATENT NO. : 4,346,262
DATED : August 24, 1982
INVENTOR(S) : LEONARDUS F. WILLEMS ET AL It is certified that error appears in the above—identified patent and that said Letters Patent is hereby corrected as shown below:

Claim 1, Col. 6, Line 9 after "=" insert -- $\alpha$ --

Signed and Sealed this

Sixteenth Day of November 1982

[SEAL]

*Attest:*

GERALD J. MOSSINGHOFF

*Attesting Officer* *Commissioner of Patents and Trademarks*